US005122395A

United States Patent [19]

Sandor

[11] Patent Number: 5,122,395

[45] Date of Patent: Jun. 16, 1992

[54] METHODS FOR THE PRODUCTION OF FAUX FINISHES

[76] Inventor: Raymond P. Sandor, 1613 10th Ave., Vero Beach, Fla. 32960

[21] Appl. No.: 669,473

[22] Filed: Mar. 14, 1991

[51] Int. Cl.[5] ..... B05D 5/00; B05D 1/36

[52] U.S. Cl. ..... 427/262; 427/263; 427/267; 427/268

[58] Field of Search ..... 427/267, 268, 274, 273, 427/262, 263

[56] References Cited

U.S. PATENT DOCUMENTS

| | | | |
|---|---|---|---|
| 1,623,967 | 4/1927 | Moross | 427/268 |
| 4,946,715 | 8/1990 | Avera | 427/274 X |
| 5,084,303 | 1/1992 | Avera | 427/264 X |

*Primary Examiner*—Evan Lawrence

*Attorney, Agent, or Firm*—Carroll F. Palmer

[57] ABSTRACT

Imitation marble or like faux finishes are produced without need for artistic manipulations of coating materials, by applying random portions of one or more different aqueous colorant mixtures to the color absorbent surface of a substrate, while such random portions are still wet, applying thereto scattered portions of an activator solution of a small amount of water-insoluble volatile organic liquid, e.g., mineral spirits, dissolved in a water-miscible alcohol, e.g., isopropyl alcohol, allowing such scattered portions to act upon the random colorant mixture portions to automatically move them into a faux finish pattern, and then allowing the resulting faux finish pattern to dry. Aqueous colorant mixtures so used each contain a major amount of water and minor amounts of colorant and, selectively, detergent and/or water-miscible alcohol.

9 Claims, No Drawings

METHODS FOR THE PRODUCTION OF FAUX FINISHES

BACKGROUND OF THE INVENTION

1. Field of the Invention

This application relates to methods and compositions for the production of faux finishes, e.g., faux marbleized finishes on furniture or other substrates.

2. Description of the Prior Art

The creation of imitation marble, granite and like faux finishes has been practiced for centuries primarily as an artistic endeavor wherein an artisan manually applies paint to a surface and manipulates it into a pattern that seeks to duplicate the appearance of natural marble, granite, etc. In order to make such operations less labor intensive, a variety of techniques have been tried to get paints or colorants when applied to a substrate to assume a marbleized design without need for detailed manipulation thereof by the artisan.

One early procedure was to mix the colorant with fermented liquor, apply it to a primed surface and, while still wet, sprinkle it with a hot solution of alkali (see U.S. Pat. No. 242,728).

Another marbleizing process involved throwing a series of colors onto a surface with a brush, sponge, or the like and then applying a thin coating of white lead, terebene and turpentine to intensify the colors (see U.S. Pat. No. 654,404).

In another process, imitation marble was alleged to result from mixing oil color with a volatile liquid, e.g., benzin or ether and a drier, applying this glazing color to a surface and then tapping the wet coating with turpentine to distribute the color into a marbled design (see U.S. Pat. No. 825,213).

More recently, in an automatic method for producing a faux finish on a continuous strip of metal channel, it is coated with oil-based paint, then immediately spattering onto the wet paint a non-uniform coating of solvent for the paint and mechanically inducing the spattered paint to flow on the coated surface (see U.S. Pat. No. 4,946,715 which contains an extensive discussion of the art of creating faux finishes).

The present invention provides yet another technique for creating faux finishes without need for an artisan to manually draw the marbled or like faux pattern on a surface made possible by the discovery of unique movement of colors applied to an absorbant surface by interaction thereof with special activation liquid.

OBJECTS

A principal object of the invention is the provision of new methods and compositions for the production of faux finishes.

A further object is the provision of such methods that produce high quality faux finishes without need for extensive artisan manipulation of colorants on the substrate and unique finishing compositions that make such methods possible even by persons untrained in the art of faux finishing.

Other objects and further scope of applicability of the precent invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished, in part, in accordance with the invention by the provision of methods for the production of a faux finish on a substrate which comprise providing a substrate having a color absorbent surface; providing at least one aqueous mixture comprising a major amount of water and a minor amount of a colorant; applying random portions of such aqueous mixture to the color absorbent surface; while the random portions are still wet, applying thereto scattered portions of an activator solution containing a small amount of water-insoluble volatile organic liquid dissolved in a water-miscible alcohol; allowing such scattered portions of special alcohol solution to act upon the random portions to move them into a faux finish pattern; and allowing the resulting faux finish pattern to dry. Preferably, a transparent protective coating is applied to the resulting dry faux finish pattern.

In preferred embodiments, the colorant is selected from water-soluble, alcohol-insoluble dyes and water-dispersible, alcohol non-dispersible pigments advantageously present in a percentage by weight of between about 0.1to 20% based on the total weight of said aqueous mixture. Also, such mixtures may contain a water-miscible alcohol, preferably selected from the group consisting of methyl, ethyl, propyl, iso-propyl and tert-butyl alcohols and mixtures thereof in an amount between about 1 to 25 percent by weight based on the total weight of the aqueous mixture.

One or more detergents can be used in aqueous mixtures of the invention, preferably the total amount thereof being present therein between about 0.1 to 5 percent. Useable detergents may be anionic, cationic or non-ionic and include soaps, alkanol sulfates, fatty acid sulfonates, polyalkylglycols, aryl sulfonates, phosphates, polyphosphates and other equivalent surfactants well known to chemical manufacturers and the detergents industry.

In preferred embodiments of the special activator solutions, the water-insoluble, volatile organic liquid is a hydrocarbon selected from the group consisting of benzene, toluene, xylene, hexane and mineral spirits and mixtures thereof and the amount thereof dissolved in the alcohol is between about 1 to 20, especially 3 to 10, percent by weight based on the total weight of the activator solution.

The objects are further accomplished by the provision of two types of compositions for use in production of faux finishes on a substrate. One such type composition consists essentially of water-miscible alcohol selected from the group consisting of methyl, ethyl, propyl, iso-propyl and tert-butyl alcohols containing dissolved therein between about 1 to 20, especially 3 to 10, percent of substantially water-insoluble, alcohol-soluble, volatile organic liquid, i.e., an organic liquid having a solubility in water at 15° C. of less than 1 gram/100 g. of water, a solubility in ethanol at 15° C. of at least 50 g./100 g. of ethanol and a boiling point at STP of less than 150° C. Such organic liquids are preferably hydrocarbons, including benzene, toluene, xylene, hexane, 1-hexene and mineral spirits or mixtures thereof, but may be other organics, e.g., halohydrocarbons, including amyl chloride, butyl chloride, and phenyl chloride; ethers, including allyl ethyl ether, butyl ethyl ether and ethyl isobutyl ether; or esters, including isoamyl acetate, isobutyl acetate and ethyl chloroacetate.

Since "pure" commercially available water-miscible alcohols typically contain some water, the special activator solutions of the invention will contain up to 15%, especially between 1 to 10%, of non-essential water. Also, such solutions may contain as non-essential components between about 0 to 10% of volatile, water-soluble organic solvents, e.g., acetone, methyl ethyl ketone, ethylamine, ethyl ether, etc.

The second type composition for use in the invention consists essentially of between about 60 to 95 percent water, 0.1 to 5 percent detergent, 0.1 to 20 percent colorant and 1 to 25 percent water-miscible alcohol. Advantageously, such alcohol is selected from the group consisting of methyl, ethyl, propyl, iso-propyl and tert-butyl alcohols and mixtures thereof. The alcohol of the second type composition does not need to be the same as the alcohol of the first type, but preferably will be.

DESCRIPTION OF THE PREFERRED EMBODIMENTS

The production of a faux finish on a substrate in accordance with the invention begins with a substrate having a color absorbent surface thereon. Typically, the substrate will be a top or other surface of a piece of furniture, a wall panel or any other surface which someone desires to make appear to be made from marble, granite or some other aesthetic appearing material of construction.

The surface of a substrate can be rendered color absorbent in a variety of ways. For example, if the substrate is wood, e.g., the top of a table, existing surface coating thereon, e.g., varnish, would preferably be removed and the surface dressed with fine abrasive paper. This would then be painted with a flat, acrylic base latex paint which, when dry, presents an ideal absorbent surface to be further treated in accordance with the invention. Oil-base flat paints and lacquer primer surfacers that produce a color absorbent surface may be used in place of latex paint.

If the substrate is metal, a suitable primer is advantageously applied before painting with the flat paint. Alternatively, with metal as well as other surfaces, e.g., plastic, wood, slate, glass, etc., a layer of absorbent paper or cloth may cemented to the substrate. In either the use of paint, paper or cloth to form the absorbent surface, it may be variegated or all white, black or colored.

With the substrate surface ready, the next step is to provide at least one aqueous mixture comprising a major amount of water, a minor amount of a colorant and, electively, a detergent and/or a water-miscible alcohol. Preferred percentages of ingredients and preferred alcohols in these aqueous mixtures have been stated previously.

The colorant should be a type that can be dissolved or dispersed in water, i.e., oil base dyes and pigments are not suitable. Since organic dyes do not remain colorfast for long periods of time, particularly when exposed to sunlight, water dispersible pigments are best used as colorants for the methods of the invention. A variety of such type pigments are commercially available typically containing ethylene glycol, diethylene glycol, microtaic and/or tributyl phosphate. White colorants, for example, may be titanium dioxide finely ground into diethylene glycol so they will mix with water.

Depending upon the marbled effect sought to be created, a single aqueous mixture of one colorant may be used with a white, black or colored substrate surface. More often, however, two or more aqueous colorant mixtures are used. In any event, portions of such mixtures are placed on the absorbent substrate surface in any desired random arrangement by spray, sponge, brush, pad, paper towel, etc. Thus, a person operating in accordance with the invention can control the final faux design by this placement of the colorant mixtures on the substrate surface, but the next step in the new methods serves to convert a drab, random placement of colorant portions into a spectacular faux finish.

The unique step in forming faux finishes of the invention occurs in applying to the randomly placed portions of colorant mixture(s), while still wet, scattered portions of a solution of a small amount the activator solution of water-insoluble volatile organic liquid dissolved in a water-miscible alcohol and allowing such scattered portions to act upon the wet, random colorant portions to move them into a faux finish pattern. When this is done, the surface of the substrate becomes alive with motion. This appears to be due to the alcohol in the scattered solution portions mixing with the water in the colorant portions and the water insoluble organic in the solution portions simultaneously coming out of solution forming puddle lines, veins or other color barriers which move the colorant into spectacular designs. At the same time, the increased percentage of alcohol entering the colorant portions helps to scale the color and adds to the decorative effects. However, this explanation may not be correct and this invention is not dependent thereon, but rather on the discovery of this unique effect which serves to create spectacular faux effects without the labor intensive requirements of prior faux finishing methods capable of producing high quality finishes.

The unique color motion action attained by the invention can be controlled to some extent by the proportions of alcohol, detergent and colorant in the colorant mixtures. For example, with use of detergent, bubbles can be formed when the colorant portions are applied and these serve to produce circular or elliptical lines, as opposed to vein-like lines. Thus, operating with a relatively high detergent content, a faux finish imitating burl wood can be obtained. However, the presence of detergent primarily serves to lower the surface tension of the colorant mixture causing it to spread evenly and to assist the alcohol solution of hydrocarbon or other organic solvent in moving the colorant into a decorative faux pattern.

After, application of the scattered activator solution portions, the resulting faux finish pattern is allowed to dry. Preferably, a transparent protective coating is applied to the resulting dry faux finish pattern.

The methods of the invention allow a person to produce a wide variety of decorative faux finishes with ease and yet allow for much creativity in the choice of color and how they are padded or otherwise easily applied to the substrate absorbent surface. Unlike old faux finish methods, a relative novice can produce high quality, decorative finishes since the unique colorant movement critical to the final effect is built into the colorant mixtures and activation alcohol solutions of the invention, eliminating the mandatory artistic skills of prior faux production methods.

Whenever percentages are referred to herein or in the appended claims, they are by weight of the relevant component (ingredient) based upon the total weight of the composition in which such component is contained.

The embodiments of the invention in which an exclusive property or privilege is claimed are defined as follows:

1. A method for the production of a faux finish on a substrate which comprises:

providing a substrate having a color absorbent surface, providing at least one aqueous mixture comprising a major amount of water and a minor amount of a colorant, applying random portions of said aqueous mixture or mixtures to said color absorbent surface, while said random portions are still wet, applying thereto scattered portions of an activator solution consisting essentially of a small amount of water-insoluble volatile organic liquid dissolved in a water-miscible alcohol, allowing said scattered portions to act upon said random portions to move them into a faux finish pattern, and allowing the resulting faux finish pattern to dry.

2. The method of claim 1 wherein a transparent protective coating is applied to the resulting dry faux finish pattern.

3. The method of claim 1 wherein said colorant is selected from dyes or pigments present in said aqueous mixtures in percentages between about 0.1 to 20% by weight.

4. The method of claim 1 wherein said aqueous mixture comprises between about 1 to 25% by weight of water-miscible alcohol.

5. The method of claim 4 wherein said water-miscible alcohol is selected from the group consisting of methyl, ethyl, propyl, iso-propyl and tert-butyl alcohols.

6. The method of claim 1 wherein the amount of said insoluble volatile organic liquid dissolved in said alcohol is between about 3 to 10% by weight.

7. The method of claim 1 wherein said water-insoluble volatile organic liquid is a hydrocarbon selected from the group consisting of benzene, toluene, xylene, hexane and mineral spirits and mixtures thereof.

8. The method of claim 1 wherein said aqueous mixture contains between about 0.1 to 5% detergent by weight.

9. The method of claim 1 wherein said activator solution contains a minor amount of water as a non-essential component.

* * * * *